US012759822B2

(12) United States Patent
Yoshimune

(10) Patent No.: US 12,759,822 B2
(45) Date of Patent: Oct. 13, 2026

(54) TRAY

(71) Applicant: BROTHER KOGYO KABUSHIKI KAISHA, Nagoya (JP)

(72) Inventor: Hideaki Yoshimune, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 87 days.

(21) Appl. No.: 18/817,686

(22) Filed: Aug. 28, 2024

(65) Prior Publication Data

US 2025/0074728 A1 Mar. 6, 2025

(30) Foreign Application Priority Data

Sep. 1, 2023 (JP) ..... 2023-141976

(51) Int. Cl.
*B65H 5/02* (2006.01)

(52) U.S. Cl.
CPC ..... *B65H 5/025* (2013.01)

(58) Field of Classification Search
CPC ..... B65H 5/02; B65H 5/025; B65H 2511/12; B65H 16/08
See application file for complete search history.

(56) References Cited

U.S. PATENT DOCUMENTS

| | | | | |
|---|---|---|---|---|
| 5,072,306 | A | 12/1991 | Matsumoto et al. | |
| 6,561,453 | B1 * | 5/2003 | Shinga | B65H 16/06 242/595.1 |
| 2021/0300090 | A1 | 9/2021 | Yamaguchi | |
| 2021/0300091 | A1 * | 9/2021 | Yamaguchi | B65H 16/08 |
| 2021/0300706 | A1 * | 9/2021 | Tsujimura | B41J 11/58 |
| 2023/0065393 | A1 * | 3/2023 | Tatematsu | B41J 15/042 |

FOREIGN PATENT DOCUMENTS

| | | |
|---|---|---|
| JP | H02-264556 A | 10/1990 |
| JP | H09-150996 A | 6/1997 |
| JP | 2004289272 A | 10/2004 |
| JP | 2021160851 A | 10/2021 |

* cited by examiner

*Primary Examiner* — Sang K Kim
(74) *Attorney, Agent, or Firm* — Element IP, PLC

(57) ABSTRACT

A tray includes: a first accommodating part accommodating a first roll having a first sheet wound thereon in a roll shape; and a second accommodating part accommodating a second roll having second sheet, of which width is smaller than a width of the first sheet, wound thereon in a roll shape, a width of the second roll being smaller than a width of the first roll. The first accommodating part has a pair of first guide surfaces facing, respectively, end surfaces in a width direction of the first roll accommodated in the first accommodating part. The second accommodating part has a pair of second guide surfaces facing, respectively, end surfaces in the width direction of the second roll accommodated in the second accommodating part. The pair of second guide surfaces are disposed on an inner side in the width direction with respect to the pair of first guide surfaces.

9 Claims, 5 Drawing Sheets

TRAY

REFERENCE TO RELATED APPLICATIONS

This application claims priority from Japanese Patent Application No. 2023-141976 filed on Sep. 1, 2023. The entire content of the priority application is incorporated herein by reference.

BACKGROUND ART

Conventionally, a sheet feed cassette including a roll sheet placement part which accommodates a roll sheet is known.

SUMMARY

In a case where a roll sheet having a small width is accommodated in the known sheet feed cassette, there is such a fear that the roll sheet having the small width might move significantly in the width direction of the roll sheet as compared to a case where a roll sheet having a large width is accommodated.

An object of the present disclosure is to provide a tray configured to position a roll in the width direction even in a case where a plurality of rolls having different widths are used.

A tray according to an aspect of the present disclosure includes: a first accommodating part and a second accommodating part. The first accommodating part is configured to accommodate a first roll including a first sheet wound thereon. The second accommodating part is configured to accommodate a second roll including a second sheet, of which width is smaller than a width of the first sheet, wound thereon. The first accommodating part includes a pair of first guide surfaces which face, respectively, end surfaces in a width direction of the first roll accommodated in the first accommodating part. The second accommodating part includes a pair of second guide surfaces which face, respectively, end surfaces in the width direction of the second roll accommodated in the second accommodating part. The pair of second guide surfaces are disposed on an inner side in the width direction with respect to the pair of first guide surfaces.

The tray of the present disclosure contributes to positioning, in the width direction, each of the first roll and the second roll having the different widths.

DESCRIPTION

Figure 1:
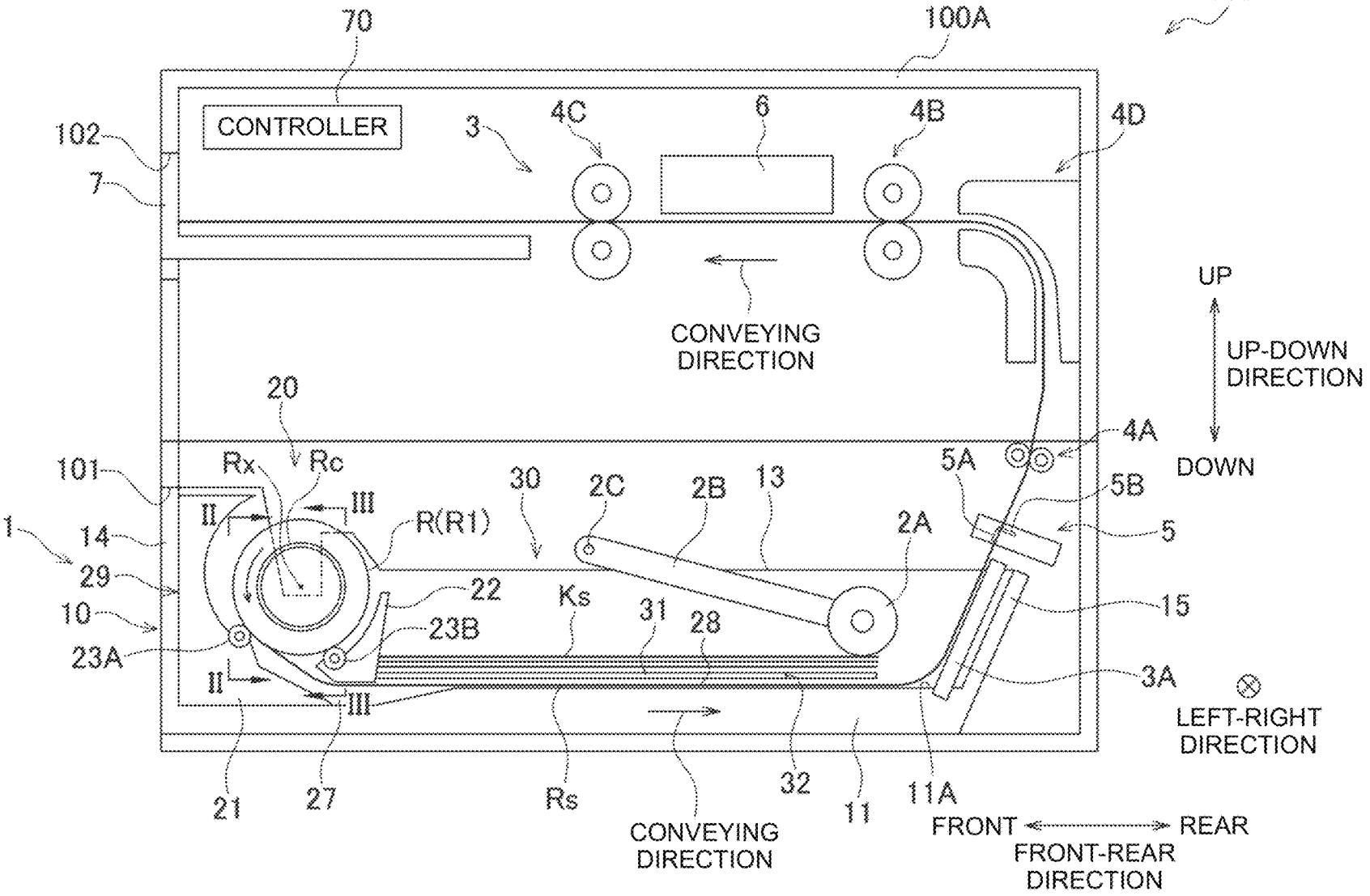
FIG. 1 is a schematic side view depicting the internal structure of a printer adopting a feed tray according to an embodiment of the present disclosure.

A printer 100 adopting a feed tray according to an embodiment of the present disclosure will be described below with reference to FIG. 1. The up-down direction, front-rear direction, and left-right direction depicted in FIG. 1 are the up-down direction, front-rear direction, and left-right direction of the printer 100. The left-right direction is the direction in a case where the printer 100 is viewed from the front; the front side in the sheet surface of FIG. 1 is the right side, and the rear side in the sheet surface of FIG. 1 is the left side. The front-rear direction (an example of a "crossing direction" of the present disclosure) is a direction which is orthogonal to the up-down direction and the left-right direction.

Overall Configuration of Printer 100

As depicted in FIG. 1, the printer 100 mainly includes a casing 100A, a feed tray 1, a conveyer 3, a cutter 5, a head 6, a sheet discharge tray 7, and a controller 70. The feed tray 1 (an example of a "tray" of the present disclosure) is disposed below the head 6 in the casing 100A. The feed tray 1 is insertable into and detachable from the casing 100A along the front-rear direction through an opening 101 defined in the front wall of the casing 100A. That is, the feed tray 1 is movable along the front-rear direction between an inner position (a position depicted in FIG. 1) at which the feed tray 1 is inside the casing 100A and an outer position at which the feed tray 1 is outside the casing 100A. In the present embodiment, the outer position is a position in front of the casing 100A. In a case where the feed tray 1 is located at the outer position, the feed tray 1 is in a state that the feed tray 1 is detached from the casing 100A. Further, the inner position is an attachment position at which the feed tray 1 is in a state of being attached to the casing 100A.

The feed tray 1 has a roll accommodating part 20 capable of accommodating a roll R, and a cut sheet accommodating part 30 capable of accommodating a plurality of cut sheets Ks in a stacked state. The roll R has a roll sheet Rs (an example of a "sheet" of the present disclosure), which is longer than the cut sheets Ks, wound around the outer circumferential surface of a core member Rc having a cylindrical shape. The roll R is accommodated in the roll accommodating part 20 such that the axial direction of a central shaft Rx of the roll R is along the left-right direction.

Note that, for the sake of description, FIG. 1 depicts a state that the feed tray 1 accommodates both the roll R and the cut sheets Ks. However, in a case where an image is to be recorded on the roll sheet Rs in the printer 100, the roll R is accommodated in the feed tray 1 and the cut sheets Ks are taken out from the feed tray 1. On the other hand, in a case where an image is to be recorded on the cut sheet(s) Ks, the cut sheets Ks are accommodated in the feed tray 1 and the roll R is taken out from the feed tray 1.

Further, the feed tray 1 in the present embodiment is configured such that the entirety of the feed tray 1 can be pulled out of the casing 100A. However, the feed tray 1 may be configured such that only a part of the feed tray 1 (for example, a rear end part of the feed tray 1) is pulled from the casing 100A. For example, the feed tray 1 may be configured such that the feed tray 1 is pullable only up to a position between the inner position and the outer position. In this case also, the feed tray 1 is preferably configured such that the roll Rs and the cut sheet(s) Ks can be accommodated, from the outside of the casing 100A, in the inside of the feed tray 1.

The conveyer 3 is configured to convey the roll sheet Rs unwound from the roll R, or the cut sheet(s) Ks, along the conveying direction. As depicted in FIG. 1, the conveyer 3 includes a feeding roller 2A, an arm 2B, a separation wall 3A, an intermediate roller pair 4A, a conveying roller pair 4B, a sheet discharging roller pair 4C, and a guide 4D.

The feeding roller 2A feeds the roll sheet Rs unwound from the roll R accommodated in the roll accommodating part 20, or a cut sheet Ks, of the cut sheets Ks accommodated in the cut sheet accommodating part 30, from the feed tray 1. The roll sheet Rs and the cut sheet Ks fed by the feeding roller 2A are fed out from the feed tray 1 in the same route. In the following description, in a case where the cut sheet(s) Ks and the roll sheet Rs are not distinguished from each other, the cut sheet(s) Ks and the roll sheet Rs will be referred to as a "sheet S".

The feeding roller 2A is pivotally supported at an end part of the arm 2B. The feeding roller 2A rotates about a shaft, extending in the left-right direction, by the drive of a non-illustrated feeding motor.

The arm 2B is rotatably supported by a support shaft 2C. The support shaft 2C is supported by the casing 100A. The arm 2B is biased by a non-illustrated biasing member so that the feeding roller 2A approaches a bottom surface 11A of the feed tray 1. The arm 2B rotates about the support shaft 2C to thereby cause the feeding roller 2A to be movable between a contact position and a separation position. In a case where the feeding roller 1A is located at the contact position, the feeding roller 2A comes into contact with a friction member (not depicted in the drawings) disposed on the bottom surface 11A of the feed tray 1. In a case where the feeding roller 1A is located at the separation position, the feeding roller 2A is separated from the friction member. The arm 2B is retractable, by a non-illustrated retracting mechanism, to a retracted position at which a tray body 10 of the feed tray 1 and the feeding roller 2A do not interfere with each other, in conjunction with a movement of the feed tray 1 from the inner position inside the casing 100A to the outer position outside the casing 100A. The separation position is a position to which the feeding roller 2A moves in a case where the arm 2B moves to the retracted position.

Further, the feeding roller 2A selectively takes a first feed position and a second feed position, between the contact position and the separation position. The first feed position is a position at which the feeding roller 2A comes into contact with the roll sheet Rs supported by the bottom surface 11A of the feed tray 1. The second feed position is a position at which the feeding roller 2A comes into contact with the cut sheet(s) Ks accommodated in the cut sheet accommodating part 30.

In a case where the feeding motor 2M is driven under the control of the controller 70, the feeding roller 2A rotates so as to apply a conveying force in a direction from the front toward the rear, with respect to the sheet S which is in contact with the feeding roller 2A. As a result, the sheet S is fed out from the feed tray 1.

The separation wall 3A contributes to preventing double feeding of the cut sheets Ks in a case where the cut sheets Ks are fed from the feed tray 1. The separation wall 3A extends obliquely upward from the bottom surface 11A of the feed tray 1. The separation wall 3A is disposed in the casing 100A. As depicted in FIG. 1, the separation wall 3A is positioned in a rear end part of the feed tray 1 in the front-rear direction.

The intermediate roller pair 4A includes a driving roller which rotates by the drive of a non-illustrated intermediate motor, and a driven roller which rotates accompanying the rotation of the driving roller. In a case where the intermediate motor is driven under the control of the controller 70, the intermediate roller pair 4A rotates while nipping and holding the sheet S. With this, the sheet S is conveyed. The intermediate roller pair 4A is positioned above the separation wall 3A. The intermediate roller pair 4A conveys the sheet S, upward, which is fed out from the feed tray 1 by the feeding roller 2A, while nipping and holding the sheet S. The guide 4D is positioned above the intermediate roller pair 4A. The guide 4D guides the sheet S conveyed upward by the intermediate roller pair 4A frontward.

The conveying roller pair 4B includes a driving roller which rotates by the drive of a non-illustrated conveying motor, and a driven roller which rotates accompanying the rotation of the driving roller. The sheet discharging roller pair 4C includes a driving roller which rotates by the drive of a non-illustrated sheet discharging motor, and a driven roller which rotates accompanying the rotation of the driving roller. In a case where the conveying motor and the sheet discharging motor are driven by the control of the controller 70, the conveying roller pair 4B and the sheet discharge roller pair 4C rotate while nipping and holding the sheet S. With this, the sheet S is conveyed. The conveying roller pair 4B is positioned behind the head 6, and the sheet discharging roller pair 4C is positioned in front of the head 6. The conveying roller pair 4B conveys the sheet S, frontward, which is guided frontward by the guide 4D, while nipping and holding the sheet S. The sheet discharging roller pair 4C conveys the sheet S, frontward, which is conveyed frontward by the conveying roller pair 4B, while nipping and holding the sheet S.

As depicted in FIG. 1, the cutter 5 is positioned between the separation wall 3A and the intermediate roller pair 4A. The cutter 5 includes a fixed blade 5A which is elongated in the left-right direction, and a disc-shaped rotary blade 5B which is movable in the left-right direction while contacting the fixed blade 5A. The rotary blade 5B is rotated by the drive of a non-illustrated cutting motor and reciprocates along the left-right direction. In a case where the cutting motor is driven under the control of the controller 70, the roll sheet Rs unwound from the roll R and conveyed is thereby cut in the left-right direction by the fixed blade 5A and the rotary blade 5B. With this, a rear end is formed in the roll sheet Rs which is cut and (being) fed to the sheet discharge tray 7.

A plurality of nozzles (not depicted) is formed in the lower surface of the head 6. The head 6 includes a driver IC (not depicted). The head 6 records an image on the sheet S conveyed by the conveyer 3. In a case where the sheet S conveyed by the conveyer 3 passes through an image recording position facing the lower surface of the head 6, the controller 70 controls the driver IC to thereby cause an ink to be ejected from the nozzles and to form an image on the sheet S. Note that the head 6 may be based on the line system in which the ink is ejected from the nozzles in a state that the position of the head 6 is fixed. Alternatively, the head 6 may be based on the serial system in which the ink is ejected from the nozzles while the head 6 is moving in the left-right direction.

The sheet discharge tray 7 is disposed, inside the casing 100A, in front of the head 6 and above the feed tray 1. The sheet discharge tray 7 is insertable into and detachable from the casing 100A along the front-rear direction through an opening 102 defined in the front wall of the casing 100A. The sheet discharge tray 7 receives the sheet S on which an image is formed by the head 6 and is conveyed frontward by the sheet discharging roller pair 4C.

The controller 70 is connected to the feeding motor, the intermediate motor, the conveying motor, the sheet discharging motor, the cutting motor, and the driver IC by an internal bus (not depicted). The controller 70 has a CPU, a ROM, and a RAM. A program, data, etc., by which the CPU performs a variety of kinds of control are stored in the ROM. The RAM temporarily stores data used by the CPU in a case where the CPU executes a program.

Configuration of Feed Tray 1

Next, the configuration of the feed tray 1 will be described with reference to FIGS. 1 to 4B. In the following description, the respective parts of the feed tray 1 will be described, based on the posture of the feed tray 1 in a state that the feed tray 1 is attached to the casing 100A.

Figure 2:
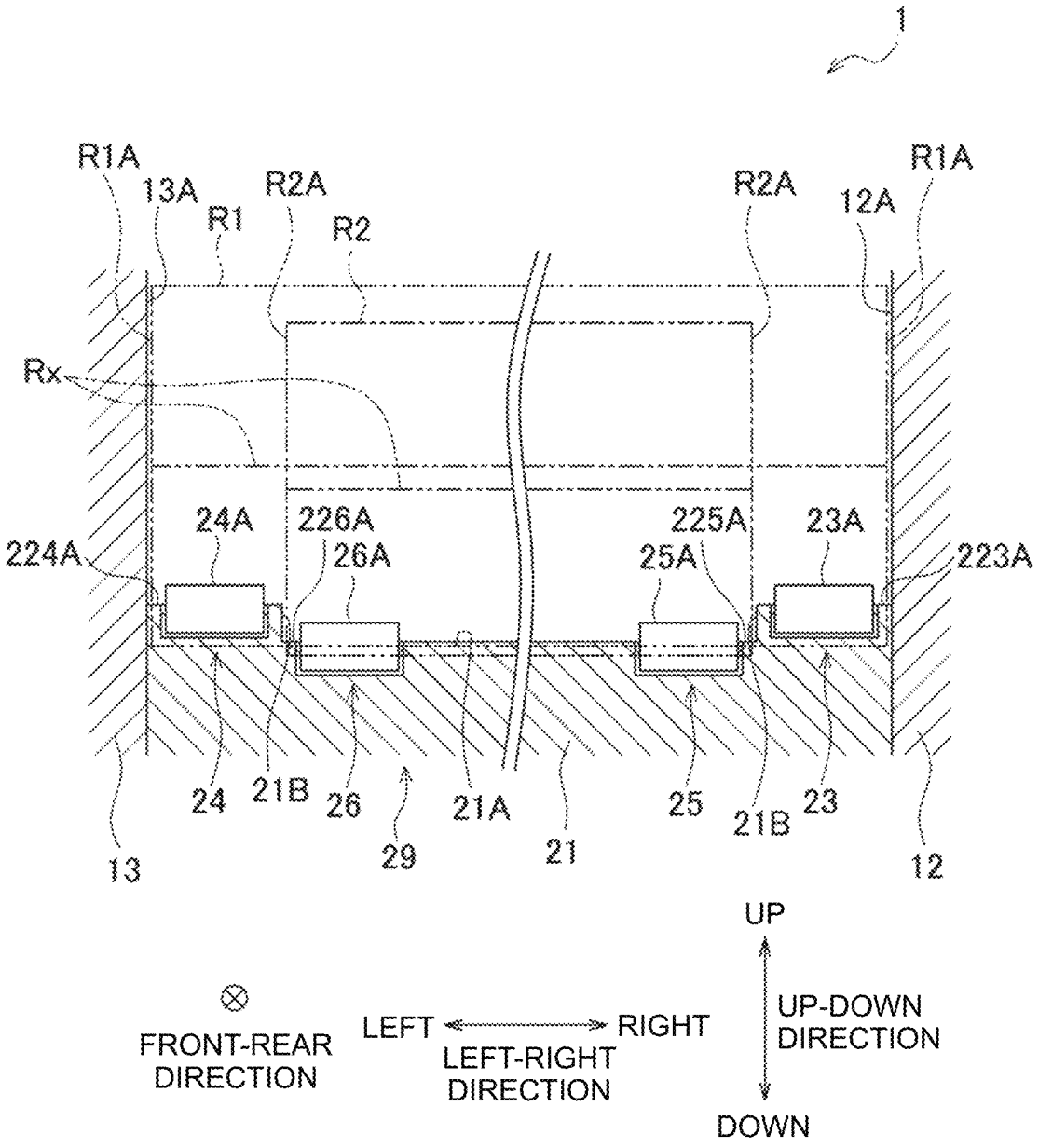
FIG. 2 is a cross-sectional view taken along a II-II line depicted in FIG. 1.

As depicted in FIG. 1, the feed tray 1 has a tray body 10. As depicted in FIGS. 1 and 2, the tray body 10 has a bottom wall 11 and four side walls 12 to 15 disposed in a peripheral edge part of the bottom wall 11, and the tray body 10 is formed in a box shape which is open upward.

The bottom wall 11 has a rectangular planar shape extending in the front-rear direction and the left-right direction. Among the four side walls 12 to 15, the pair of side walls 12 and 13 disposed on the left and right extend upward, respectively, from both left and right end parts of the bottom wall 11. Further, the pair of side walls 12 and 13 extend from a front end part to a rear end part of the bottom wall 11 along the front-rear direction.

The side wall 14 extends upward from a front end part of the bottom wall 11. The side wall 14 extends in the left-right direction from the right end part to the left end part of the bottom wall 11. Two side walls 15 are disposed in the rear end part of the bottom wall 11. The two side walls 15 are positioned, respectively, at both left and right end parts, in the left-right direction, of the rear end part of the bottom wall 11. The two side walls 15 are disposed to be separated from each other in the left-right direction; in a case where the feed tray 1 is attached to the casing 100A, the separation wall 3A (see FIG. 1) is located between the two side walls 15 aligned in the left-right direction.

The roll accommodating part 20 accommodates the roll R in a posture in which the axial direction of the central shaft Rx coincides with the left-right direction. The roll accommodating part 20 and the cut sheet accommodating part 30 are disposed side by side in the front-rear direction. The roll accommodating part 20 is positioned in front of the cut sheet accommodating part 30.

Further, the roll accommodating part 20 has a support part 29 which supports the roll R from below, as depicted in FIGS. 1 and 2. The support part 29 is disposed in a front part of the bottom wall 11. The support part 29 has two holders 21 and 22 and four sets of roll supporting parts 23 to 26, and supports the roll R to be rotatable while supporting the outer circumferential surface of the lower part of the accommodated roll R. The roll R rotates around the central shaft Rx.

As depicted in FIG. 2, the roll accommodating part 20 has a first accommodating part 20A capable of accommodating the first roll R1 and a second accommodating part 20B capable of accommodating the second roll R2, and is configured to selectively accommodate the first roll R1 and the second roll R2. The first roll R1 has a length in the width direction greater than a length in the width direction of the second roll R2. That is, the width of the roll sheet Rs constructing the first roll R1 is greater than the width of the roll sheet Rs constructing the second roll R2. The term "width direction" is the short direction of the roll sheet Rs, and is a direction along the central shaft Rx of the roll R. In the present embodiment, the width of the roll sheet Rs constructing the first roll R1 corresponds to the width of an A3-sized sheet or a legal-sized sheet. The width of the roll sheet Rs constructing the second roll R2 corresponds to the width of an A4-sized sheet or a letter-sized sheet. The width of each of the first roll R1 and the second roll R2 may be changed as appropriate, and is not particularly limited. In the following description, in a case where the first roll R1 and the second roll R2 are not distinguished from each other, the first roll R1 and the second roll R2 will be referred to as a "roll R".

The two holders 21 and 22 are disposed separately from each other in the front-rear direction. The holder 21 is positioned in front of the holder 22. Each of the two holders 21 and 22 extends along the left-right direction.

Figure 3:
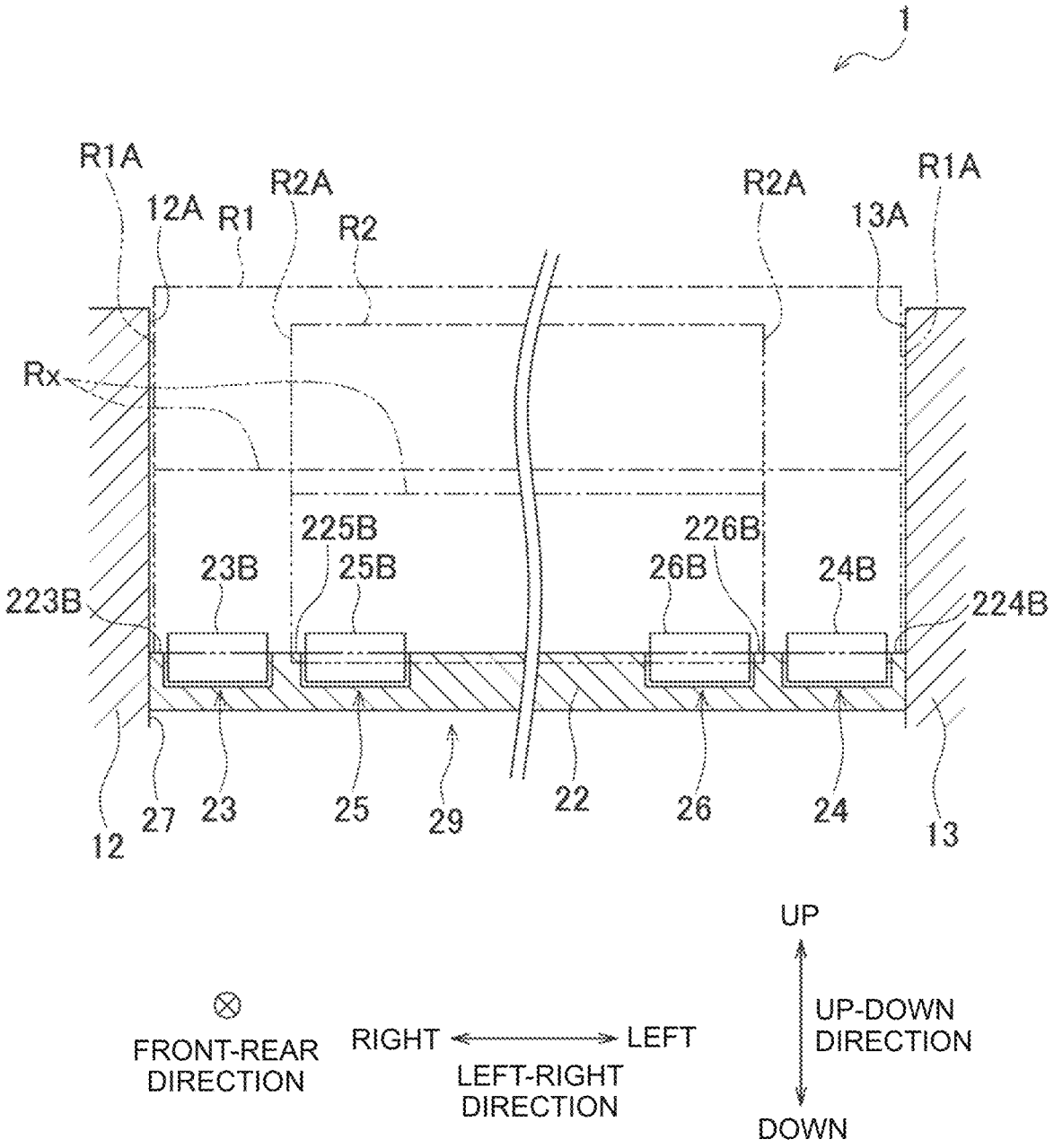
FIG. 3 is a cross-sectional view taken along a III-III line depicted in FIG. 1.

As depicted in FIGS. 2 and 3, a roll supporting part 23 and a roll supporting part 24 (an example of a "pair of first supporting parts" of the present disclosure) are disposed separately from each other in the left-right direction so as to support both end parts in the left-right direction of the first roll R1 from below. The roll supporting part 23 has a pair of supporting rollers 23A and 23B which are disposed, respectively, at positions sandwiching the lower end of the first roll R1 in the front-rear direction and which contact the outer circumferential surface of a lower part of the first roll R1. The roll supporting part 24 has a pair of supporting rollers 24A and 24B which are disposed, respectively, at positions sandwiching the lower end of the first roll R1 in the front-rear direction and which contact the outer circumferential surface of the lower part of the first roll R1. The supporting rollers 23A and 23B, and the supporting rollers 24A and 24B are each an example of a "first dividing support part" of the present disclosure.

As depicted in FIGS. 2 and 3, a roll supporting part 25 and a roll supporting part 26 (an example of a "pair of second supporting parts" of the present disclosure) are disposed separately from each other in the left-right direction so as to support both end parts in the left-right direction of the second roll R2 from below. The roll supporting part 25 and the roll supporting part 26 are disposed between the roll supporting part 23 and the roll supporting part 24 in the left-right direction. The roll supporting part 25 has a pair of supporting rollers 25A and 25B which are disposed, respectively, at positions sandwiching the lower end of the second roll R2 in the front-rear direction and which contact the outer circumferential surface of the lower part of the second roll R2. The roll supporting part 26 has a pair of supporting rollers 26A and 26B which are disposed, respectively, at positions sandwiching the lower end of the second roll R2 in the front-rear direction and which contact the outer circumferential surface of the lower part of the second roll R2. The supporting rollers 25A and 25B, and the supporting rollers 26A and 26B are each an example of a "second dividing support part" of the present disclosure.

As depicted in FIG. 2, the four supporting rollers 23A, 24A, 25A and 26A are disposed so that the rotation shafts of the supporting rollers 23A, 24A, 25A and 26A are parallel to the left-right direction, and are rotatably supported by the holder 21. The two supporting rollers 23A and 24A are disposed at both end parts in the left-right direction of the holder 21. Further, the two supporting rollers 23A and 24A are disposed on the same rotation shaft. The two supporting rollers 25A and 26A are disposed on the inner side in the left-right direction with respect to the two supporting rollers 23A and 24A. Furthermore, the two supporting rollers 25A and 26A are disposed on the same rotation shaft.

As depicted in FIG. 2, the holder 21 has a recessed part 21A which is recessed downward on the inner side in the left-right direction with respect to the both end parts in the left-right direction. The two supporting rollers 25A and 26A are disposed at the both end parts in the left-right direction of a bottom part of the recessed part 21A. In such a manner, each of the two supporting rollers 25A and 26A is disposed at a position one stage lower than one of the two supporting rollers 23A and 24A. In other words, the rotation shafts of the two supporting rollers 23A and 24A are located above the rotation shafts of the two supporting rollers 25A and 26A, as depicted in FIG. 4B.

As depicted in FIG. 3, the four supporting rollers 23B, 24B, 25B and 26B are disposed so that the rotation shafts of the supporting rollers 23B, 24B, 25B and 26B are parallel to the left-right direction, and are rotatably supported by the holder 22. The two supporting rollers 23B and 24B are disposed, respectively, at the both end parts in the left-right direction of the holder 21. The two supporting rollers 25B and 26B are disposed on the inner side in the left-right direction with respect to the two supporting rollers 23B and 24B. Further, the four supporting rollers 23B, 24B, 25B and 26B are disposed on the same rotation shaft. Furthermore, the rotation shafts of the four supporting rollers 23B, 24B, 25B and 26B are positioned below the rotation shafts of the supporting rollers 25A and 26A. Note that the positions in the left-right direction are the same in the pair of rollers 23A and 23B are the same. Similarly, the positions in the left-right direction are the same in each of the pair of rollers 24A and 24B, the pair of rollers 25A and 25B and the pair of rollers 26A and 26B. Moreover, these supporting rollers 23A, 23B, 24A, 24B, 25A, 25B, 26A, and 26B are all of the same shape and size.

Figure 4A:
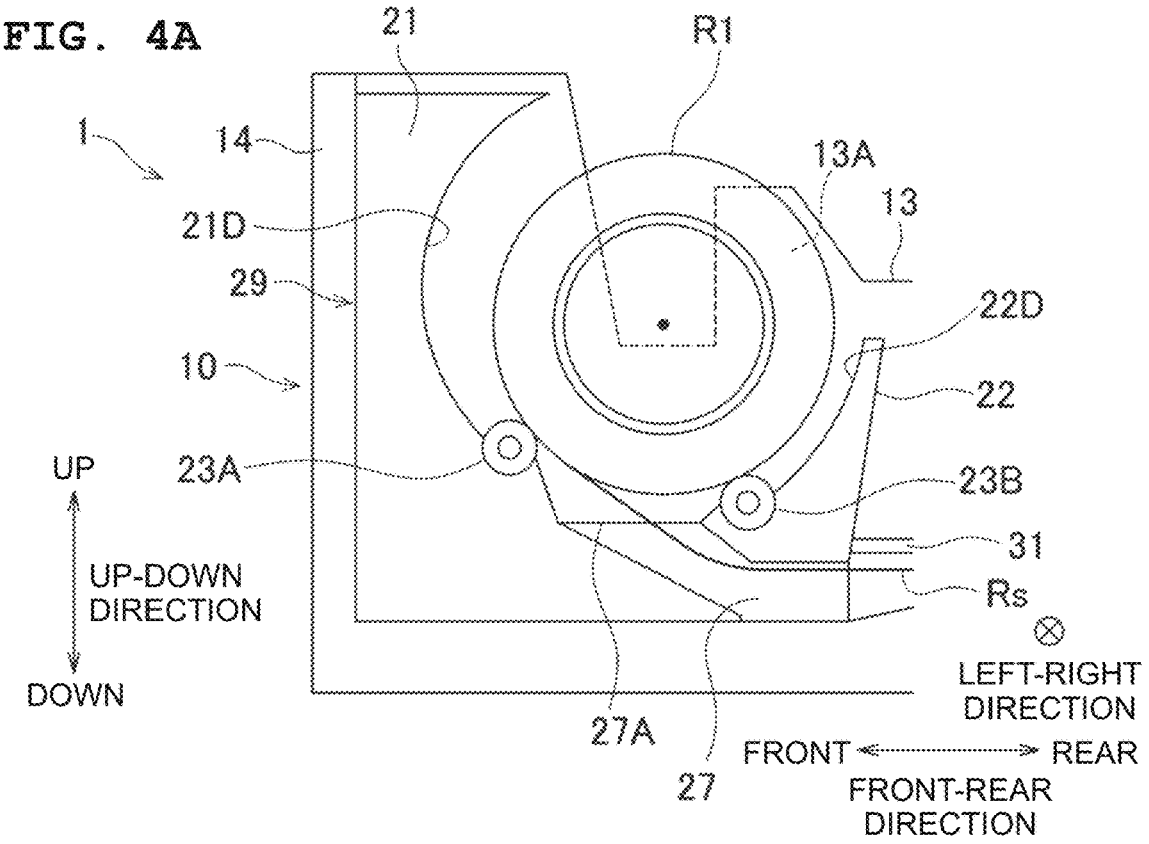
FIG. 4A is a side view of the main parts of the feed tray, depicting a state that a first roll is accommodated in a first accommodating part.
Figure 4B:
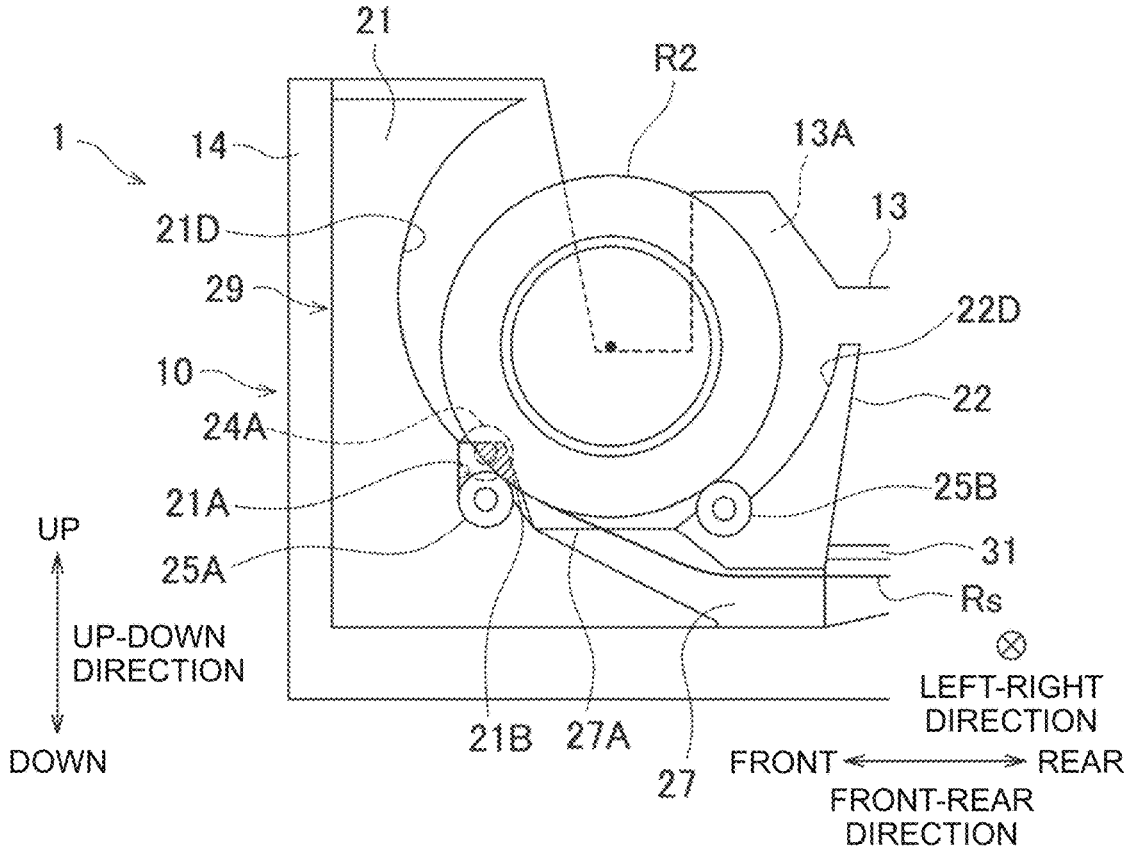
FIG. 4B is a side view of the main parts of the feed tray, depicting a state that a second roll is accommodated in a second accommodating part.

As depicted in FIG. 2 and FIG. 4A, the first accommodating part 20A has a pair of guide surfaces 12A and 13A (an example of a "first guide surface" of the present disclosure). The pair of guide surfaces 12A and 13A are positioned in front parts of the pair of side walls 12 and 13, respectively. The pair of guide surfaces 12A and 13A are adjacent to and face, in the left-right direction, end surfaces RIA of the first roll R1 supported by the two sets of roll supporting parts 23 and 24. Further, the pair of guide surfaces 12A and 13A are formed at positions, respectively, in the pair of side walls 12 and 13 which overlap, along the left-right direction, with the first roll R1 accommodated in the first accommodating part 20A. In other words, the pair of guide surfaces 12A and 13A overlap with the first roll R1 accommodated in the first accommodating part 20A in a case where the pair of guide surfaces 12A and 13A are viewed from the left-right direction. Furthermore, the first accommodating part 20A also includes the two sets of roll supporting parts 23 and 24 which support the first roll R1. As depicted in FIG. 4A, the first accommodating part 20A is defined by a rear wall surface 21D of the holder 21, a front wall surface 22D of the holder 22, and the pair of guide surfaces 12A and 13B.

The heights of the supporting rollers 23A and 23B and the supporting rollers 24A and 24B constructing the roll supporting part 23 and the roll supporting part 24, respectively, are not all the same in the up-down direction, as depicted in FIGS. 2, 3, 4A and 4B. More specifically, the supporting rollers 23A and 24A, which are positioned in front of the lower end of the first roll R1, are disposed, respectively, above the supporting rollers 23B and 24B which are positioned behind the lower end of the first roll R1.

Further, the second accommodating part 20 has a pair of guide surfaces 21B (an example of a "pair of second guide surfaces" of the present disclosure) as depicted in FIG. 2 and FIG. 4B. The pair of guide surfaces 21B are present, respectively, in the both end surfaces in the left-right direction of the inner surface of the recessed part 21A, and are adjacent to and face end surfaces R2A in the left-right direction of the second roll R2 supported by the two sets of roll supporting parts 25 and 26. More specifically, the pair of guide surfaces 21B are formed at a position indicated by hatching in FIG. 4B. In such a manner, the pair of guide surfaces 21B are formed in the inner surface of the recessed part 21A, and are disposed at a position at which the pair of guide surfaces 21B does not overlap with the pair of guide surfaces 12A and 13A along the left-right direction. That is, the pair of guide surfaces 21B do not overlap with the pair of guide surfaces 12A and 13A in a case where the pair of guide surfaces 21B are viewed from the left-right direction. With this, the pair of guide surfaces 12A and 13A are prevented from becoming greater than necessary. Provided that the pair of guide surfaces 12A and 13A and the pair of guide surfaces 21B overlap along the left-right direction, the pair of guide surfaces 12A and 13A become greater than necessary. Further, the pair of guide surfaces 21B overlap with the second roll R2 accommodated in the second accommodating part 20B in a case where the pair of guide surfaces 21B are viewed from the left-right direction. Furthermore, the second accommodating part 20B includes the two sets of roll supporting parts 25 and 26 which support the second roll R2. The second accommodating part 20B is defined by the rear wall surface 21D of the holder 21, the front wall surface 22D of the holder 22, and the pair of guide surfaces 21B.

Moreover, the pair of guide surfaces 21B are disposed on the inner side in the left-right direction with respect to the pair of guide surfaces 12A and 13A. More specifically, one guide surface 21B of the pair of guide surfaces 21B is disposed between the roll supporting part 23 and the roll supporting part 25 in the left-right direction. The other guide surface 21B of the pair of guide surfaces 21B is disposed between the roll supporting part 24 and the roll supporting part 26 in the left-right direction.

The heights of the supporting rollers 25A and 25B and the supporting rollers 26A and 26B constructing the roll supporting part 25 and the roll supporting part 26, respectively, are not all the same in the up-down direction, as depicted in FIGS. 2, 3, 4A and 4B. More specifically, the supporting rollers 25A and 26A positioned in front of the lower end of the second roll R2 are disposed, respectively, slightly above the supporting rollers 25B and 26B positioned behind the lower end of the second roll R2. As depicted in FIG. 3, a portion of a part, of the second accommodating part 20B, in which the second roll R2 is accommodated and which is a space (a space above the recessed part 21A) where the supporting rollers 25B and 26B and the most of the second roll R2 are located is present within a part of the first accommodating part 20A in which the first roll R1 is accommodated. With this, an area occupied by the first accommodating part 20A and the second accommodating part 20B can be made smaller than in a case where the entirety of the second accommodating part 20B is positioned outside the first accommodating part 20A. Therefore, the feed tray 1 can be made compact.

On the other hand, the recessed part 21A and the supporting rollers 25A and 26A, each of which is another part different from the above-described part of the second accommodating part 20B, are positioned below the first accommodating part 20A as depicted in FIG. 2. Since the supporting rollers 25A and 26A are disposed at the bottom part of the recessed part 21A formed in the holder 21, each of the supporting rollers 25A and 26A supports the second roll R2 at a position one stage lower than one of the supporting rollers 23A and 24A. Therefore, even in such a case where the diameter of the second roll R2 becomes small by using the roll sheet Rs of the second roll R2, the second roll R2 is supported from below at a constant position, and the end surfaces R2A of the second roll R2 and the pair of second guide surfaces 21B continue to face each other. Therefore, the positioning of the second roll in the width direction is stable. Further, the size of the feed tray 1 can be prevented from increasing in the front-rear direction.

Further, the holder 22 is disposed so as to define a passage 27, which is configured to guide the roll sheet Rs unwound from the roll R, between the lower surface of the holder 22 and the bottom surface 11A of the tray 1, as depicted in FIGS. 4A and 4B. The passage 27 has an inlet 27A disposed between the pair of the rollers 23A and 23B in the front-rear direction. The inlet 27A is disposed, in the front-rear direction, between the pair of the rollers 24A and 24B, is disposed between the pair of the rollers 25A and 25B, and is disposed between the pair of the rollers 26A and 26B. The roll sheet Rs unwound from the roll R selectively accommodated in either the first accommodating part 20A and the second accommodating part 20B is caused to pass through the passage 27 from the inlet 27A between the two holders 21 and 22, and is drawn out along the bottom surface 11A onto the friction member (not depicted in the drawings).

As depicted in FIG. 1, the cut sheet accommodating part 30 has a support plate 31 disposed on the bottom wall 11. The support plate 31 is a plate-like member extending in the front-rear direction and the left-right direction, and supports the cut sheet Ks from below with an upper surface 31A of the support plate 31. The cut sheet accommodating part 30 in the present embodiment is configured to be capable of accommodating cut sheets Ks of the A4 size or the letter size. Note that the size of the cut sheets Ks may be changed as appropriate, and is not particularly limited.

As depicted in FIG. 1, a part of a front end part of the support plate 31 is inserted into a lower part of the holder 22. Further, a rear end part of the support plate 31 is configured to be swingable upward and downward, with the part of the support plate 31 inserted into the holder 22 as the fulcrum. Furthermore, the support plate 31 extends rearward from the fulcrum to the vicinity of a rear end part of the bottom surface 11A.

Further, as depicted in FIG. 1, the support plate 31 and the bottom wall 11 define a passage 28. The passage 28 is a passage configured to pass the roll sheet Rs unwound from the roll R. In other words, the support plate 31 is disposed so as to face the bottom surface 11A so that the roll sheet Rs can pass between the support plate 31 and the bottom surface 11A. Note that the support plate 31 also has a function of preventing the curling of the roll sheet Rs passing between the support plate 31 and the bottom surface 11A.

The support plate 31 has a cutout part 32 formed in the rear end part of the support plate 31. The cutout part 32 is disposed at the center of the support plate 31 in the left-right direction. The cutout part 32 is positioned in the movement trajectory of the feeding roller 2A which is movable from the contact position to the separation position. Note that the friction member is positioned in the inside of the cutout part 32 of the support plate 31.

Next, the procedure for setting the roll R and the cut sheets Ks will be described below.

Procedure for Setting First Roll R1

In a case where the first roll R1 is to be set in the roll accommodating part 20, the feed tray 1 is pulled and detached from the casing 100A. Further, at this time, in a case where the cut sheets Ks are accommodated in the cut sheet accommodating part 30, the cut sheets Ks are taken out. Furthermore, at this time, in a case where the second roll R2 is accommodated in the second accommodating part 20B, the second roll R2 is taken out. Then, the first roll R1 is set in the first accommodating part 20A by holding the both end parts in the left-right direction of the core member Rc of the first roll R1. Namely, as indicated by a two-dot-chain line in FIGS. 2 and 3, the both end parts in the left-right direction of the first roll R1 are placed on the two sets of roll supporting parts 23 and 24. In this situation, the both end surfaces RIA of the first roll R1 are guided by the pair of guide surfaces 12A and 13A. As a result, the first roll R1 is stably supported by the first accommodating part 20A. After that, the first roll R1 is rotated counterclockwise in FIG. 1, and the roll sheet Rs is caused to pass through passages 27 and 28. Then, the roll sheet Rs is drawn out until a forward end of the roll sheet Rs is positioned downstream of the friction member in the conveying direction. In this state, the feed tray 1 is moved from the outer position outside the casing 100A to the inner position inside the casing 100A. As a result, the feeding roller 2A, together with the friction member, nips and holds the roll sheet Rs, and the roll sheet Rs can be fed.

Procedure for Setting Second Roll R2

In a case where the second roll R2 is to be set in the roll accommodating part 20, the feed tray 1 is pulled and detached from the casing 100A. Further, at this time, in a case where the cut sheets Ks are accommodated in the cut sheet accommodating part 30, the cut sheets Ks are taken out, similarly to the above-described procedure of setting the first roll R1. Furthermore, at this time, in a case where the first roll R1 is accommodated in the first accommodating part 20A, the first roll R1 is taken out. Then, the second roll R2 is set in the second accommodating part 20B by holding the both end parts in the left-right direction of the core member Rc of the second roll R2. Namely, as indicated by a two-dot-chain line in FIGS. 2 and 3, the both end parts in the left-right direction of the second roll R2 are placed on the two sets of roll supporting parts 25 and 26. In this situation, the both end surfaces R2A of the second roll R2 are guided by the pair of guide surfaces 21B. As a result, the second roll R2 is stably supported by the second accommodating part 20B. After that, the second roll R2 is rotated counterclockwise in FIG. 1, and the roll sheet Rs is caused to pass through passages 27 and 28. Then, the roll sheet Rs is drawn out until a forward end of the roll sheet Rs is positioned downstream of the friction member in the conveying direction. In this state, the feed tray 1 is moved from the outer position outside the casing 100A to the inner position inside the casing 100A. As a result, the feeding roller 2A, together with the friction member, nips holds the roll sheet Rs, and the roll sheet Rs can be fed.

Procedure for Setting Cut Sheets Ks

In a case where the cut sheets Ks are to be set in the cut sheet accommodating part 30, the feed tray 1 is pulled and detached from the casing 100A similarly to the above description. In this situation, in a case where the roll R is accommodated in the first accommodating part 20, the roll R is taken out from the first accommodating part 20. Afterwards, a plurality of cut sheets Ks is accommodated in the stacked state in the cut sheet accommodating part 30. In this state, the feed tray 1 is moved from the outer position outside the casing 100A to the inner position inside the casing 100A. As a result, the feeding roller 2A comes into contact with an uppermost cut sheet Ks located at the uppermost position of the plurality of cut sheets Ks, and the cut sheets Ks can be fed.

As described above, according to the feed tray 1 of the present embodiment, the pair of guide surfaces 21B of the second accommodating part 20B are disposed on the inside in the left-right direction with respect to the pair of guide surfaces 12A and 13A of the first accommodating part 20A. With this, in a case where the first roll R is to be used, the first roll R1 can be positioned in the left-right direction by the pair of guide surfaces 12A and 13A of the first accommodating part 20A. Further, in a case where the second roll R2 is to be used, the second roll R2 can be positioned in the left-right direction by the pair of guide surfaces 21B of the second accommodating part 20B. Thus, even in a case where the first roll R1 and the second roll R2 having the different widths are used, each of these rolls R, namely, the first roll R1 and the second roll R2, can be positioned in the width direction (left-right direction).

A separation distance in the width direction between the pair of guide surfaces 12A and 13A configured to position the first roll R1 is slightly greater than the width of the first roll R1. Further, a separation distance in the width direction between the pair of guide surfaces 21B configured to position the second roll R2 is slightly greater than the width of the second roll R2. The phrase "is slightly greater than" means a size capable of ensuring stable feeding of the unwound roll sheet Rs and the precision in a printing performed on the roll sheet R by the head 6 even in a case where the first roll R1 disposed between the pair of guide surfaces 12A and 13A or the second roll R2 disposed between the pair of guide surfaces 21B moves in the left-right direction or the central shaft Rx of the first roll R1 or the second roll R2 is inclined with respect to the left-right direction. Furthermore, in FIG. 2, the height in the up-down direction of the pair of guide surfaces 21B is a height of such an extent that, even in a case where the second roll R2 rotates as a result of the unwound roll sheet Rs being fed from the accommodated second roll R2, the second roll R2 does not climb over the pair of guide surfaces 21B due to the momentum of the rotation. Note that the height in the up-down direction of the pair of guide surfaces 12A and 13A is also a height of such an extent that the first roll R1, which rotates as a result of the unwound roll sheet Rs being fed from the accommodated first roll R1, does not climb over the pair of guide surfaces 12A and 13A due to the momentum of the rotation.

The pair of roll supporting parts 23 and 24 are disposed separately from each other in the left-right direction, and the pair of roll supporting parts 25 and 26 are disposed separately from each other in the left-right direction. Accordingly, each of the first roll R1 and the second roll R2 can be supported stably.

The inlet 27A of the passage 27 is disposed between the pair of supporting rollers 23A and 23B in the front-rear direction. Similarly, in the front-rear direction, the inlet 27A is disposed between the pair of supporting rollers 24A and 24B, is disposed between the pair of supporting rollers 25A and 25B, and is disposed between the pair of supporting rollers 26A and 26B. With this, the roll sheet Rs unwound from the roll R can be guided from the inlet 27A through the passage 27. Further, the roll supporting part 23 has the pair of supporting rollers 23A and 23B, the roll supporting part 24 has the pair of supporting rollers 24A and 24B, the roll supporting part 25 has the pair of supporting rollers 25A and 25B, and the roll supporting part 26 has the pair of supporting rollers 26A and 26B. Therefore, the first roll R1 can be stably supported by the two pairs of the supporting rollers 23A and 23B and the supporting rollers 24A and 24B, and the second roll R2 can be stably supported by the two pairs of the supporting rollers 25A and 25B and the supporting rollers 26A and 26B. Furthermore, the roll R can be supported so as to be rotatable more smoothly.

The two supporting rollers 25A and 26A are disposed in the bottom part of the recessed part 21A, and are disposed below the two supporting rollers 23A and 24A. In other words, among the two pairs of the supporting rollers 25A and 25B and the supporting rollers 26A and 26B, the supporting rollers 25A and 26A, disposed upstream of the lower end of the roll R in an advancing direction (a direction from the front to the rear in the present embodiment) in which the roll sheet Rs unwound from the roll R advances by being guided by the passage 27, are disposed, respectively, below the supporting roller 23A and the supporting roller 24A disposed upstream of the lower end of the roll R in the advancing direction among the two pairs of the supporting rollers 23A and 23B and the supporting rollers 24A and 24B. The passage 27 extends from the inlet 27A toward a location below the two supporting rollers 25B and 26B. As a result, even in a case where the supporting rollers 25A and 26A are disposed, respectively, below the supporting rollers 23A and 24A, the supporting rollers 25A and 26A do not interfere with the passage 27. For this reason, the two supporting rollers 25A and 26A can be easily disposed.

The supporting rollers 25A and 26A are disposed, respectively, above the supporting rollers 25B and 26B. With this, the distance along the circumferential direction of the second roll R2 from the supporting rollers 25A and 26A each as one roller of the pair to the supporting rollers 25B and 26B each as the other roll of the pair can be made great, while preventing the separation distance between the supporting rollers 25A and 26A and the supporting rollers 25B and 26B of the two pairs from increasing in the front-rear direction. Owing to this, the feed tray 1 is prevented from becoming large in size in the front-rear direction while causing the roll sheet Rs to be unwound easily from the second roll R2.

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below:

Modification

Figure 5:
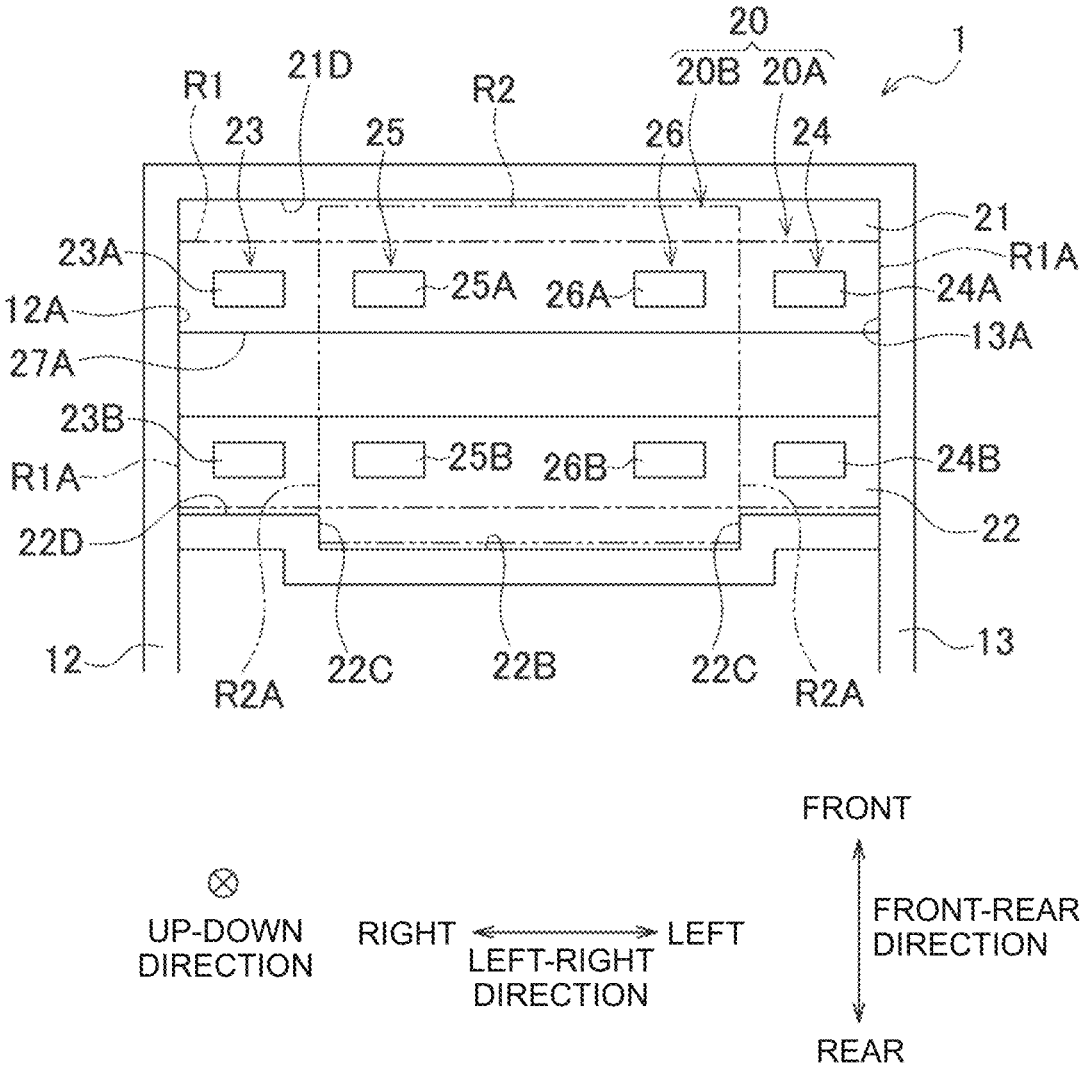
FIG. 5 is a plan view of the main parts of a feed tray according to a modification.

In the above-described embodiment, although the two supporting rollers 25A and 26A are disposed below the two supporting rollers 23A and 24A, these four supporting rollers 23A, 24A, 25A and 26A may be disposed at the same height, similarly to the four supporting rollers 23B, 24B, 25B and 26B. In this modification, as depicted in FIG. 5, a recessed part 22B is formed in a front wall surface 22D of the holder 22. The length in the left-right direction of the recessed part 22B is slightly greater than the width in the left-right direction of the second roll R2.

Further, the second accommodating part 20 has a pair of guide surfaces 22C (an example of the "pair of second guide surfaces" of the present disclosure) as depicted in FIG. 5. The pair of guide surfaces 22C are present, respectively, on both end surfaces in the left-right direction of the inner surface of the recessed part 22B, and are a part adjacent to and facing end surfaces R2A in the left-right direction of the second roll R2 supported by the two sets of roll supporting parts 25 and 26. In this modification also, the separation distance in the width direction between the pair of guide surfaces 22C is slightly greater than the width of the second roll R2, and has a size capable of ensuring the stable feeding of the unwound roll sheet Rs and the precision in the printing performed on the roll sheet Rs by the head 6, similarly to the above-described embodiment. In such a manner, the pair of guide surfaces 22C are formed in the inner surface of the recessed part 22B, and are disposed at a position at which the pair of guide surfaces 22C do not overlap with the pair of guide surfaces 12A and 13A along the left-right direction. That is, the pair of guide surfaces 22C do not overlap with the pair of guide surfaces 12A and 13A in a case where the pair of guide surfaces 22C are viewed from the left-right direction. Further, the pair of guide surfaces 22C overlap with the second roll R2 accommodated in the second accommodating part 20B in the case where the pair of guide surfaces 22C are viewed from the left-right direction. Furthermore, the pair of guide surfaces 22C are disposed on the inside in the left-right direction with respect to the pair of guide surfaces 12A and 13A. More specifically, one guide surface 22C of the pair of guide surfaces 22 is disposed between the roll supporting part 23 and the roll supporting part 25 in the left-right direction. The other guide surface 22C of the pair of guide surfaces 22 is disposed between the roll supporting part 24 and the roll supporting part 26 in the left-right direction. Further, in FIG. 5, the length in the front-rear direction of the pair of guide surfaces 22C is equal to or greater than a length of such an extent the second roll R2, which rotates as a result of the unwound roll sheet Rs being fed from the accommodated second roll R2, does not climb over the pair of guide surfaces 22C due to the momentum of the rotation, similarly to the above-described embodiment.

In such a manner, the second accommodating part 20B in the present modification has the pair of guide surfaces 22C, instead of the above-mentioned pair of guide surfaces 21B, and is configured to be capable of accommodating the second roll R2. Also in a feed tray 1 in the present modification, the pair of guide surfaces 22C of the second accommodating part 20B are disposed on the inner side in the left-right direction with respect to the pair of guide surfaces 12A and 13A of the first accommodating part 20A. With this, in a case where the first roll R1 is to be used, the first roll R1 can be positioned in the left-right direction by the pair of guide surfaces 12A and 13A of the first accommodating part 20A. Further, in a case where the second roll R2 having the diameter greater than the diameter of the first roll R1 is to be used, the second roll R2 can be positioned in the left-right direction by the pair of guide surfaces 22C of the second accommodating part 20B. In such a manner, even in a case where the first roll R1 and the second roll R2 having the different widths are used, each of the rolls R (which are the first roll R1 and the second roll R2) can be positioned in the width direction.

As depicted in FIG. 5, a part, of the second accommodating part 20B, in which the second roll R2 is accommodated, the part being a space (a space in front of the recessed part 22B) wherein the pair of supporting parts 25 and 26, which are different from the recessed part 22B, are disposed, and in which the most of the second roll R2 is placed is present within the first accommodating part 20A. With this, an effect similar to the effect obtained in the above-described embodiment can be obtained. Note that a similar effect can be obtained in a similar configuration as the configuration of the above-described embodiment.

Further, a recessed part similar to the recessed part 22B may be further formed in the rear wall surface 21D of the holder 21. The recessed part may be formed in line symmetry with respect to the recessed part 22B, relative to the rotation shaft of the second roll R2 accommodated in the second accommodating part 20B. This allows the recessed part also to have a pair of guide surfaces 22C. Accordingly, the second roll R2 accommodated in the second accommodating part 20B can be positioned by the pair of guide surfaces 22C disposed on the front and the rear sides. Note that in a case where the pair of guide surfaces 22C are formed in the rear wall surface 21D, the pair of guide surfaces 22C may not be formed in the front wall surface 22D.

Although the embodiment of the present disclosure has been described, the present disclosure is not limited to the above-described embodiment, and various changes are possible within the scope of the claims. In the above-described embodiment and modification, although a part of the second accommodating part 20B is present inside the first accommodating part 20A, the entirety of the second accommodating part 20B may be present outside the first accommodating part 20A while being shifted frontward or rearward with respect to the first accommodating part 20A. In this case also, the second accommodating part 20B may have a pair of guide surfaces facing the end surfaces R2A of the second roll R2. With this, even in a case where the first roll R1 and the second roll R2 having the different widths are used, these rolls R1 and R2 can be positioned R in the width direction.

In the above-described embodiment, although the two supporting rollers 25A and 26A are disposed below the two supporting rollers 23A and 24A, the two supporting rollers 25B and 26B may also be disposed below the two supporting rollers 23B and 24B. In this case, a pair of guide surfaces similar to the pair of guide surfaces 21B may be formed in the holder 22. Further, the two supporting rollers 25A and 26A may be disposed at a same height as the two supporting rollers 23A and 24A, and the two supporting rollers 25B and 26B may be disposed below the two supporting rollers 23B and 24B. In this case also, a pair of guide surfaces similar to the pair of guide surfaces 21B may be formed in the holder 22. In these cases also, since the pair of guide surfaces similar to the pair of guide surfaces 21B are formed in the holder 22, an effect similar to the effect obtained in the above-described embodiment can be obtained.

Further, a pair of first guide surfaces facing the end surfaces RIA of the first roll R1 accommodated in the first accommodating part and a pair of second guide surfaces facing the end surfaces R2A of the second roll R2 accommodated in the second accommodating part may overlap along the left-right direction. In other words, an outer area of each of the pair of first guide surfaces, which is outside an area, of each of the pair of first guide surfaces, facing the end surfaces RIA may be disposed to overlap an area, of each of the pair of second guide surfaces, facing the end surfaces R2A, in a case where these areas are viewed from the left-right direction.

In the above-described embodiment and modification, although the first roll R1 is supported by the supporting rollers 23A, 23B, 24A and 24B and the second roll R2 is supported by the supporting rollers 25A, 25B, 26A and 26B, these supporting rollers 23A to 26B may be omitted, and the roll R1 may be supported by the wall surfaces of the holder 21 and the roll R2 may be supported by the wall surfaces of the holder 22. In this case, as depicted in FIGS. 2 and 3, wall surface parts 223A and 223B and wall surface parts 224A and 224B capable of supporting the first roll R1 construct the first dividing support parts of respective pairs, and wall surface parts 225A and 225B and wall surface parts 226A and 226B capable of supporting both ends of the second roll R2 construct the second dividing support parts of respective pairs.

Further, the passage 27 may be omitted. In this case, the roll sheet Rs unwound from the roll R may be pulled beyond the upper end of the holder 22 and toward the feeding roller 2A.

Furthermore, although the above-described roll supporting parts 23 to 26 are configured to be capable of supporting the both end parts in the left-right direction of the roll R, the roll supporting parts 23 to 26 may be configured to be capable of supporting a part, of the roll R, which is different from the both end parts in the left-right direction of the roll R.

The present disclosure is applicable to general trays capable of accommodating the roll R. In other words, the feed tray 1 may be unable to accommodate the cut sheets Ks. In other words, the feed tray 1 may not have the cut sheet accommodating part 30. Further, the support plate 31 also may be omitted. The feed tray 1 may be supported movably with respect to the casing 100A, in a direction crossing the front-rear direction and the up-down direction.

Furthermore, for example, the present disclosure is applicable not only to an ink-jet printer including, as a recording part, a head which ejects an ink from a nozzle, but is applicable also, for example, to an electrophotographic printer including a recording part based on the laser system configured to form an electrostatic latent image by exposing a photoreceptor with a laser beam, or based on the LED system configured to form an electrostatic latent image by exposing a photoreceptor with an LED. Moreover, the sheet-like medium is not limited to a paper sheet, and may be cloth, resin materials such as films, etc., as long as having a sheet-like shape.

What is claimed is:

1. A tray comprising:

a first accommodating part configured to accommodate a first roll including a first sheet wound thereon; and a second accommodating part configured to accommodate a second roll including a second sheet, of which width is smaller than a width of the first sheet, wound thereon, wherein the first accommodating part includes a pair of first guide surfaces which face, respectively, end surfaces in a width direction of the first roll accommodated in the first accommodating part, the second accommodating part includes a pair of second guide surfaces which face, respectively, end surfaces in the width direction of the second roll accommodated in the second accommodating part, the pair of second guide surfaces are disposed on an inner side in the width direction with respect to the pair of first guide surfaces, the second accommodating part includes a supporting roller which supports the second roll, and an upper end of the pair of second guide surfaces is higher than an upper end of the supporting rollers.

2. The tray according to claim 1, wherein a portion of a part, of the second accommodating part, in which the second roll is accommodated is present within a part, of the first accommodating part, in which the first roll is accommodated.

3. The tray according to claim 2, wherein another part, of the second accommodating part, which is different from the part, is positioned below the first accommodating part.

4. The tray according to claim 3, wherein the first accommodating part includes a pair of first supporting parts separated from each other in the width direction, the pair of first supporting parts is configured to contact an outer circumferential surface of a lower part of the first roll, respectively, at both ends in the width direction of the first roll and to support the first roll from below, the second accommodating part includes a pair of second supporting parts separated from each other in the width direction, the pair of second supporting part is configured to contact an outer circumferential surface of a lower part of the second roll, respectively, at both ends in the width direction of the second roll and to support the second roll from below, the another part includes at least a part of the pair of second supporting parts, and the pair of second guide surfaces, at least the part of the pair of second supporting parts is positioned below the pair of first supporting parts, and the pair of second guide surfaces are disposed between the pair of first supporting parts and the pair of second supporting parts in the width direction.

5. The tray according to claim 4, wherein each of the pair of first supporting parts includes a pair of first dividing support parts which are disposed, respectively, at positions at which the pair of first dividing support parts sandwich a lower end of the first roll in a crossing direction crossing the width direction and an up-down direction, each of the pair of second supporting parts includes a pair of second dividing support parts which are disposed, respectively, at positions at which the pair of second dividing support parts sandwich a lower end of the second roll in the crossing direction, and the tray further comprises a passage having an inlet which is defined between the pair of first dividing support parts and the pair of second dividing support parts, the passage being configured to guide the first sheet unwound from the first roll or the second sheet unwound from the second roll.

6. The tray according to claim 5, wherein the passage is positioned below the pair of first supporting parts and the pair of second supporting parts, one second dividing support part included in the pair of second dividing support parts and disposed upstream of the lower end of the second roll in an advancing direction in which the second sheet unwound from the second roll is guided by the passage and advances is positioned below one first dividing support part included in the pair of first dividing support parts and disposed upstream of the lower end of the first roll in the advancing direction.

7. The tray according to claim 6, wherein in the up-down direction, the one second dividing support part is disposed at a position different from a position of the other second dividing support part of the pair of second dividing support parts.

8. The tray according to claim 4, wherein each of the pair of first supporting parts has a roller which supports the first roll, and each of the pair of second supporting parts has the supporting roller which supports the second roll.

9. The tray according to claim 1, wherein the pair of second guide surfaces are disposed, respectively, at positions not overlapping with the pair of first guide surfaces along the width direction.

* * * * *